US006689973B2

(12) United States Patent
Meagher et al.

(10) Patent No.: US 6,689,973 B2
(45) Date of Patent: Feb. 10, 2004

(54) ELECTRO-MECHANICAL DOOR LATCH SWITCH ASSEMBLY AND METHOD FOR MAKING SAME

(75) Inventors: James Patrick Meagher, Indianapolis, IN (US); Vaughn Clark Arens, Greenwood, IN (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/411,787

(22) Filed: Apr. 11, 2003

(65) Prior Publication Data

US 2003/0173197 A1 Sep. 18, 2003

Related U.S. Application Data

(63) Continuation-in-part of application No. 10/262,496, filed on Oct. 1, 2002, which is a continuation of application No. 09/753,829, filed on Jan. 3, 2001, now Pat. No. 6,465,752.

(51) Int. Cl.[7] ..... H01H 13/00

(52) U.S. Cl. ..... 200/61.73; 200/511; 200/512; 200/341; 200/520

(58) Field of Search ..... 70/278; 200/17 R, 200/511, 512, 61.58 R, 520, 341, 85 R, 61.41–61.44; 292/201; 307/9.1, 10 R, 10.1; 340/5.2, 5.51; 361/71

(56) References Cited

U.S. PATENT DOCUMENTS

| | | | | |
|---|---|---|---|---|
| 4,342,210 A | | 8/1982 | Denningham | 200/5 E |
| 4,496,803 A | | 1/1985 | Smith | 200/5 A |
| 4,624,491 A | | 11/1986 | Vincent | 292/201 |
| 4,762,348 A | | 8/1988 | Matsumoto | 292/201 |
| 5,654,687 A | | 8/1997 | LaBonde | 340/426 |
| 5,717,429 A | | 2/1998 | Coulon et al. | 345/168 |
| 5,775,142 A | | 7/1998 | Kim | 70/277 |
| 5,821,482 A | | 10/1998 | Ootani et al. | 200/5 A |
| 5,967,297 A | | 10/1999 | Kaufman et al. | 200/241 |
| 6,075,294 A | | 6/2000 | Van den Boom et al. | 307/10.1 |
| 6,191,682 B1 | | 2/2001 | Wolfgang | 340/5.2 |
| 6,465,752 B2 | | 10/2002 | Meagher et al. | 200/61.73 |
| 6,494,615 B2 | * | 12/2002 | Wyssbrod | 200/520 |

* cited by examiner

*Primary Examiner*—Michael A. Friedhofer
(74) *Attorney, Agent, or Firm*—Harness, Dickey & Pierce, P.L.C.

(57) ABSTRACT

A switching apparatus and electro-mechanical latching system includes an elastomeric button with independently movable electrically conducting spring plates mounted to the button. The button includes a plurality of elastomeric posts extending from an inboard surface thereof for retaining the spring plate to the button. A leadframe is disposed in the base and includes electrical tracks for communicating with a vehicle computer. Each spring plate includes a plurality of cantilever springs. When the button is depressed, the cantilever springs of the spring plates come in contact with electrical tracks to complete a circuit. The completion of the circuit causes a signal to be sent to a vehicle computer, which signals a motor to release the automotive vehicle door latch.

25 Claims, 6 Drawing Sheets

ELECTRO-MECHANICAL DOOR LATCH SWITCH ASSEMBLY AND METHOD FOR MAKING SAME

This application is a CIP of Ser. No. 10/262,496, filed Oct. 1, 2002 which is a continuation of Ser. No. 09/753,829, filed Jan. 3, 2001 and having U.S. Pat. No. 6,465,752.

FIELD OF THE INVENTION

The present invention relates generally to door latches for automobile and other vehicle applications and, more particularly, to a switch assembly for an electro-mechanical door latch mechanism.

DISCUSSION

Traditionally, mechanical devices have been used to latch and unlatch closures such as doors, trunks, hoods, lift gates and hatches and the like in automobiles and other vehicles. As a means to reduce the effort that is necessary to operate such closures, it is known to utilize an electro-mechanical door latch mechanism. For example, a user actuated switch can be employed to trigger the release of a mechanical latch. In this regard, an electrical switch is operable to provide an input to a controller for operating the mechanical latch when it is actuated. In addition, modern styling and ergonomic requirements may dictate the physical configuration of the switch. For example, the switch may need to comprise an aesthetically pleasing user actuation component (e.g., a low profile button) that is of adequate size and shape so as to be easily operated by a user under a wide variety of operating conditions in a wide variety of environments.

Known switch technology for such applications generally incorporates a button having a plurality of electrically conductive "pills" that are insert molded within the interior of the top of the button. The pills complete a circuit when the switch is actuated. For example, when the button is depressed, the conductive pills contact electrically conductive "tracks" included on a base portion of the switch assembly and short the two electrical inputs to ground. The conductive pills also serve as mechanical "stops" for preventing the button from being further depressed after electrical contact is made.

A known problem that is inherent with the foregoing switch technology, however, is that the several pills do not function independently of one another to ground the electrical input to the switch. Thus, it is possible that the button may be fully depressed, yet the switch is not actuated because the pill or pills do not make adequate contact with both the input and ground side of the electrical tracks. In such a case the pill or pills are brought into contact with only one electrical track. For example, due to the size and/or configuration of the button, it is not uncommon for the button to rock or teeter when an off-center actuation force is applied to depress the button. In such a case only one of the pills is brought into contact with one electrical track. As a result, the reliability of the switch is diminished. In order to address this issue, expensive conducting materials have been used to make the pills. The cost of the switch, though, is correspondingly increased.

Consequently, it is desirable to provide a switching apparatus having a lower cost than conventional switch technology, and with a more reliable actuation mechanism.

SUMMARY OF THE INVENTION

A switch assembly for triggering the release of a door latch is disclosed. In an exemplary application for a preferred embodiment of the invention, a switch assembly mounted on the exterior of an automobile door assembly includes an elastomeric button having a plurality of elastomeric posts extending from an inboard surface thereof. An electrically conductive spring plate has a plurality of apertures for accepting the plurality of projections or posts therethrough. The posts interface with the apertures to urge the spring plate into engagement with the inboard surface of the button. A base supports the button and includes a leadframe disposed thereon. The leadframe includes electrically conductive tracks and communicates with a vehicle computer. Depressing the button causes at least a portion of the spring plate to engage the electrically conductive tracks and complete a circuit, initiating the release of the latch.

A method for assembling a switch assembly for triggering the release of a door latch includes providing an elastomeric button having a plurality of elastomeric, generally cylindrical posts extending from an inboard side thereof. An electrically conductive spring plate is provided and includes a plurality of complimentary apertures therein for accepting each of the plurality of elastomeric posts. The spring plate is placed over the inboard side of the button such that the posts are received in and extend through the apertures in the spring plate.

The posts are then loaded in tension in a direction along their respective longitudinal axes. As such, the elastomeric posts stretch and narrow in diameter. The spring plate is simultaneously urged toward the inboard side of the button. The posts are subsequently released from the tensile load and allowed to relax, returning their pre-stretched diameters. The spring plate is further urged into contact with the inboard side of the button. The button is subsequently installed into a base.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENT(S)

Figure 1:
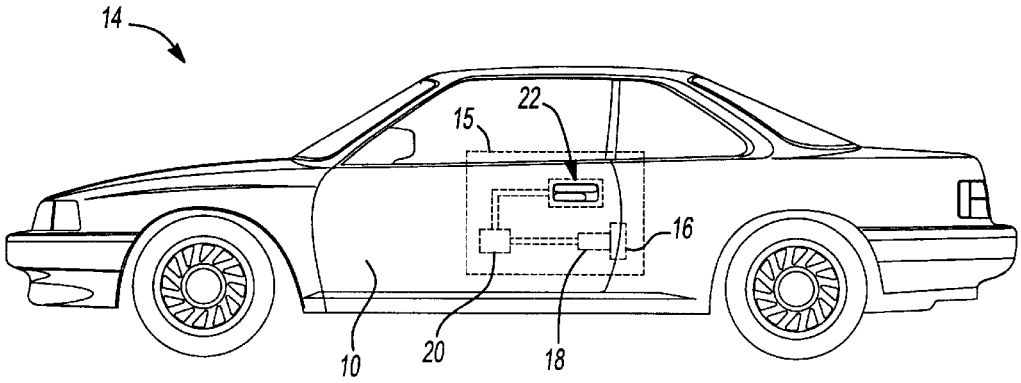
FIG. 1 is a side elevational view of an automobile showing a schematic representation of an electro-mechanical door-latching mechanism in accordance with a preferred embodiment of the present invention.

With reference to FIG. 1 of the drawings, an automobile 14 is shown including a door 10 which is movable between an opened and a closed position. The door 10 is secured in the closed position by an electro-mechanical latch mechanism 15. The electro-mechanical latch mechanism 15 may comprise a user-actuated switch assembly 22, a controller 20 (e.g., a computer), a solenoid 18 (or, alternatively, an electric motor), and a mechanical latch 16 (which may or may not be integral to the solenoid 18).

In order to open the door 10, the latch mechanism 15 securing the door 10 must first be released. Release of the latch mechanism 15 is triggered by a user's manual actuation of the switch assembly 22. The switch assembly 22 provides a low-current switch to ground. The controller 20 monitors the switch assembly 22 for a change in state. When the controller 20 receives a ground signal input from the switch assembly 22, the controller 20 operates the solenoid 18 to disengage the mechanical latch 16, enabling the door 10 to be opened.

Although it is illustrated in FIG. 1 in the context of an automobile door, it should be appreciated that the latch mechanism 15 may be utilized for securing hoods, trunks, lift gates, sliding doors, hatches, or the like, on automobiles and other vehicles.

Figure 2:
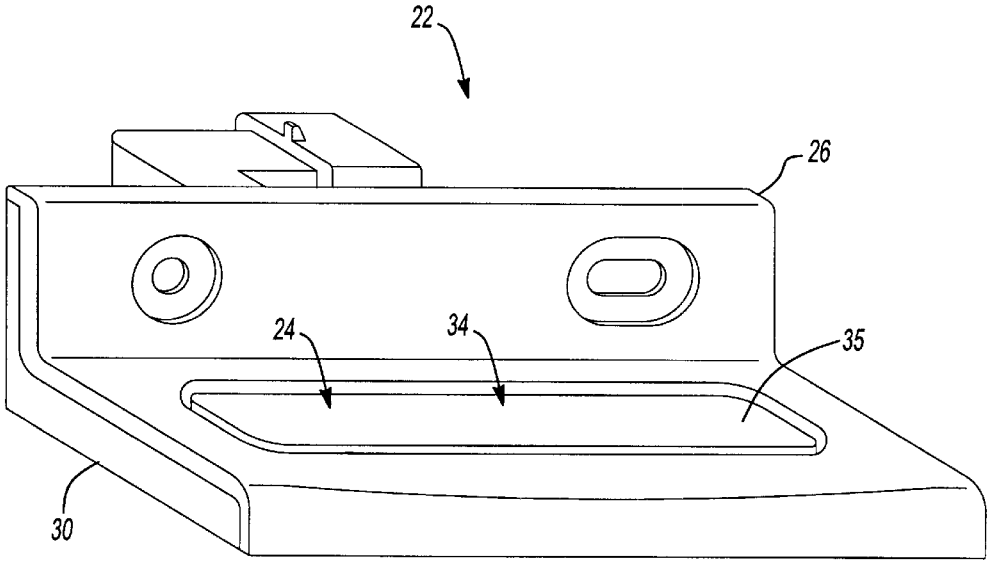
FIG. 2 is a perspective view of a switch assembly in accordance with a first preferred embodiment for use in the electro-mechanical door-latching mechanism shown in FIG. 1.
Figure 3:
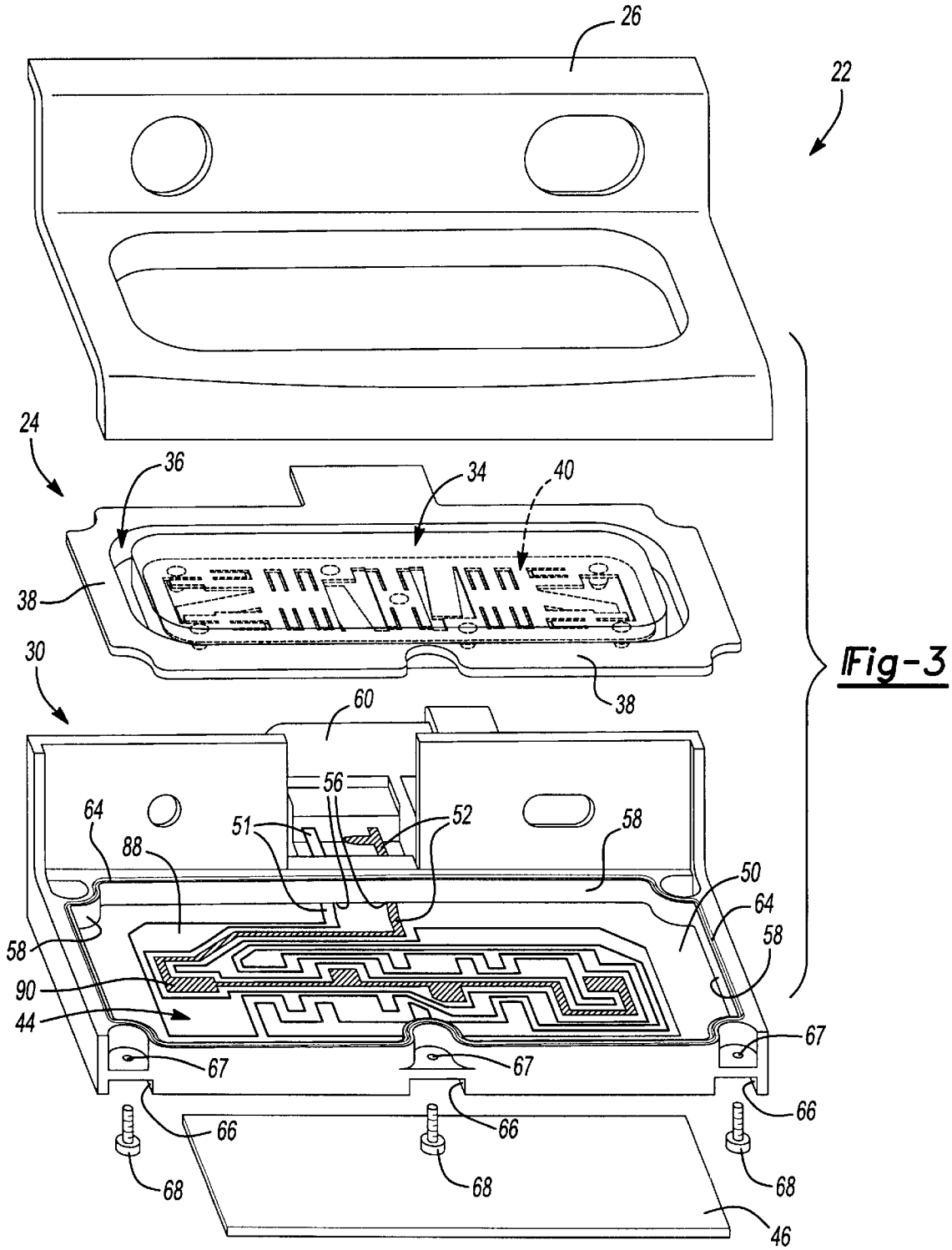
FIG. 3 is an exploded perspective view of the switch assembly shown in FIG. 2.

With reference to FIGS. 2 and 3, a switch assembly 22 according to a first preferred embodiment of the invention is shown. The switch assembly 22 generally includes a cover member 26, a base member 30, a button member 24, a spring plate 40 and a leadframe 44.

The cover member 26 and base member 30 are cooperable to form the outer shell of the switch assembly 22. The button member 24 is housed in the interior of the switch assembly 22 and is disposed between the cover member 26 and base member 30.

The button member 24 is preferably of a unitary construction and is formed from a thin, flexible, elastomeric material. The thickness of the elastomeric material forming the button member 24, however, may vary so as to obtain the desired features and operating characteristics for the button member 24, as will become apparent from the discussion below.

The button member 24 generally includes a central actuation portion 34 and peripheral flange portion 38. The actuation portion 34 has an exterior surface or face 35, and an interior surface 42. Located intermediate the actuation portion 34 and the flange portion 38 is a channel 36 that forms a perimeter boundary for the actuation portion 34 and both the exterior surface 35 and the interior surface 42. The actuation portion 34 has a thickness that is greater than both the flange portion 38 and channel 36. Consequently, the actuation portion 34 is relatively much stiffer than the remainder of the button member 24.

Figure 3A:
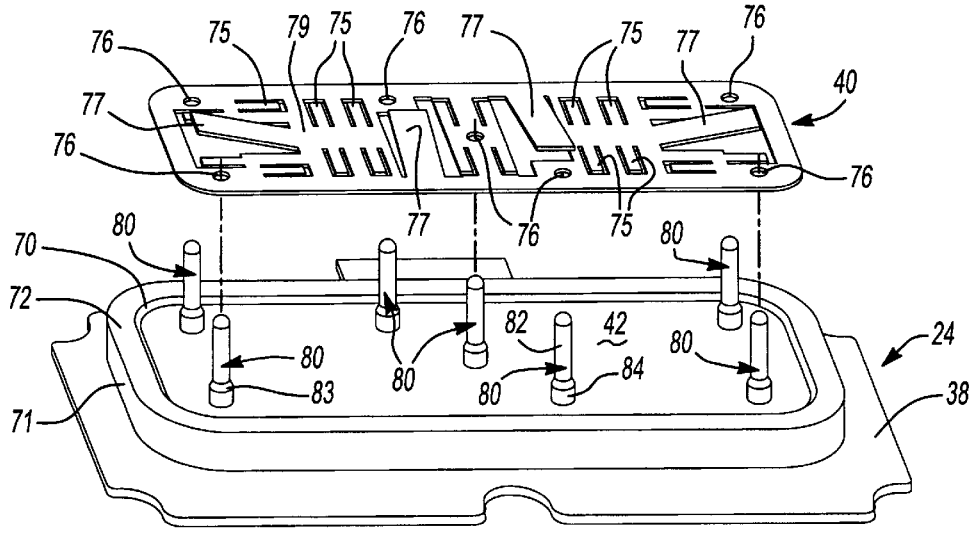
FIG. 3A is an exploded perspective view of a button comprising a plurality of elastomeric, generally cylindrical posts and a spring plate, both of which are employed in the switch assembly shown in FIG. 2.

With particular reference to FIG. 3A, the channel 36 can be seen from the back side of the button member 24 (i.e., the side of the button opposite to the exterior surface 35). The channel 36 is formed by an outer peripheral wall 71, surface 72, and an inner peripheral wall or depression wall 70. The depression wall 70 has a relatively much thinner wall thickness than the remainder of the channel 36 and the actuation portion 34. As a result, when a force is applied to the actuation portion 34 of the button member 24 at exterior surface 35, the actuation portion 34 substantially retains its shape while the depression wall 70 is subject to deformation and buckles or collapses. Upon subsequent release of the button member 24, the depression wall 70 returns to its original shape and the button member 24 "rebounds" to its pre-actuated configuration.

As illustrated in FIGS. 3A–3D, extending from the interior surface 42 of the button member 24 are a plurality of column-like projections or posts 80. The projections 80 are also made from an elastomeric material and are preferably, though not necessarily, integrally formed with the button member 24. Although shown in the FIGs. as being generally cylindrical, it should be understood that the projections may have a cross-sectional configuration of any suitable geometric shape, such as square, rectangular, triangular, polygonal and the like. The projections 80 generally include a distal portion 82 having a first cross-section or diameter and a proximal portion 84 having a second cross-section or diameter, with the proximal diameter being greater than the distal diameter. A transition portion 83 may also be included between the distal portion 82 and the proximal portion 84.

A spring plate 40 is attached at the interior surface 42 of the button member 24. The spring plate 40 comprises a plurality of cantilever springs 77 that extend outward from the plane of its surface 79. The spring plate and its cantilever springs are made from and/or plated with an electrically conductive material, like a metal such as silver. The spring plate 40 also includes a plurality of apertures 76 extending through the spring plate 40 at various locations across its surface 79. The apertures 76 cooperate with the projections 80 extending from the interior surface 42 of the button member 24 to provide a means for securing the spring plate 40 to the interior surface 42 of the button member 24, as described in greater detail below.

In order to assemble the spring plate 40 to the interior surface 42 of the button member 24, the spring plate 40 is first placed over the button member 24 such that each of the projections 80 extends through a corresponding aperture 76 in the spring plate 40. The apertures 76 are sized to provide sufficient clearance to receive only the distal portions 82 of the projections 80. Thus, the spring plate 40 rests above the proximal portions 84 of the projections 80 and is slightly offset from the interior surface 42 of the button member 24.

Figure 3B:
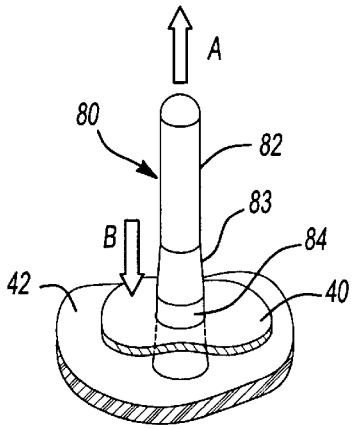
FIG. 3B is a partial perspective view showing the enlarged detail of a spring plate and an elastomeric post wherein the post is extending through an aperture in the spring plate and is loaded in tension in a direction along its longitudinal axis such that it is stretched and narrowed in diameter while the spring plate is being installed.
Figure 3C:
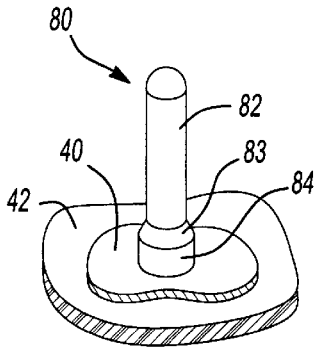
FIG. 3C is a partial perspective view showing the enlarged detail of a spring plate and an elastomeric post wherein the post is released from the tensile load subsequent to installation of the spring plate.

Once the distal portions 82 of the projections 80 are received in the apertures 76, the projections 80 are then loaded in tension (e.g., they are pulled in a direction away from the button member 24 as shown by arrow A of FIG. 3B) such that they elongate along their respective longitudinal axes. Upon loading, the projections 80 correspondingly "neck down"—that is, the diameters of their respective proximal portions 84 are reduced. In this state, the proximal portions 84 of the projections 80 are narrower than the apertures 76 in the spring plate 40 and the spring plate 40 may be moved further down the projections 80 and seated against the interior surface 42 of the button member 24, as shown by arrow B of FIG. 3B. The projections 80 are subsequently released from tension, causing the diameter of the proximal portions 84 to return to their pre-tensioned dimensions, as shown in FIG. 3C. At this point, the proximal portions 84 of the projections 80 provide an outwardly radial bias against the apertures 76 of the spring plate 40 to secure the spring plate 40 in a position in close proximity to or directly against the interior surface 42 of the button member 24.

Figure 3D:
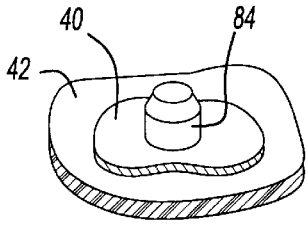
FIG. 3D is a partial perspective view showing the enlarged detail of a spring plate and an elastomeric post subsequent to installation of the spring plate wherein a distal portion of the post has been removed.

Subsequently, the distal portions 82 of the projections 80 are preferably removed (see, e.g., FIG. 3D).

It should be appreciated that spring plate 40 may be attached to the button member 24 by any of a variety of other methods. For example, the button member may alternatively include projections extending therefrom having both distal and proximate portions, whereby the distal portions are of increased diameter relative to the proximal portions. In this way, the distal portions would have diameters greater than the radius of the apertures in the spring plate, thus capturing the spring plate between the distal portions and the inboard face of the button.

A leadframe 44 is insert molded into or otherwise affixed to an interior surface 50 of the base member 30. The leadframe 44 comprises of two electrically conducting traces or tracks 88, 90, representing an input and ground respectively. Although trace 90 is configured as the ground, it is appreciated that trace 88 may alternatively be configured as the ground. As seen in FIG. 3, the traces 88, 90 wind in a generally serpentine manner across the interior surface 50 of the base member 30 and are terminated at leads 51, 52, respectively. The leads 51, 52 of the leadframe 44 pass through passages 56 that are incorporated in an outer wall 58 of the base member 30. A sealant, such as epoxy, is disposed in the passages 56 and around the leads 51, 52 to seal the interior space of the base member 30. The leads 51, 52 terminate at a connector or fitting 60. The connector 60 provides the interface at which the switch assembly 22 can be electrically connected to the controller 20.

Also shown in FIG. 3, an interior wall 58 of the base member 30 includes a ridge 64 raised from and extending around a perimeter of the base member 30. Fastener insets 66 that include apertures 67 are also provided in the base member 30 and are arranged at locations around the base member 30. The apertures 67 receive fasteners 68 for joining the base member 30 to the cover member 26.

When the switch assembly 22 is assembled, the flange 38 of the button member 24 aligns with the ridge 64 of the base member 30. The fasteners 68 extend through the apertures 67 of the fastener insets 66 of the base member 30 and are received and secured in bosses (not specifically shown) located on the underside of the cover member 26. The ridge 64 of the base member 30 engages the flange 38 of the button member 24 and forms a seal. One skilled in the art will readily recognize that any of a variety of methods may be used to secure the switch assembly's 22 cover member 26 to the base member 30.

Optionally, the base 30 may include an elastomeric damper 46 disposed at the bottom of the base member 30, as shown in FIG. 3. The damper 46 reduces the potential for vibrations and noise to be propagated to the switch assembly 22 from the door 10 when the switch assembly 22 is mounted on the door 10.

Figure 4:
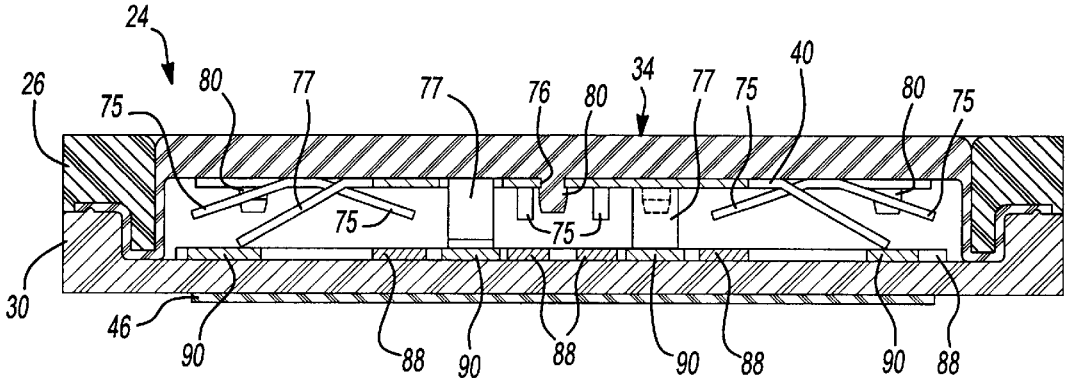
FIG. 4 is a cross-sectional front view of the switch assembly of FIG. 2 along the section line 4—4.
Figure 5:
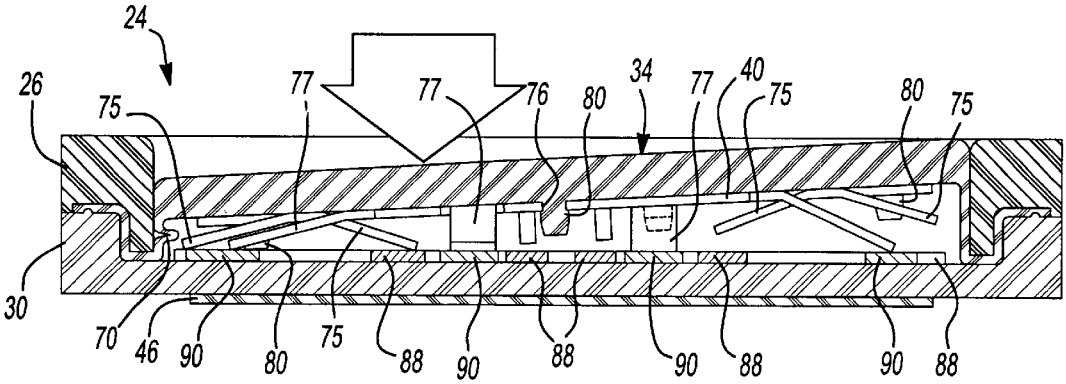
FIG. 5 is a cross-sectional front view of the switch assembly of FIG. 2 as shown in FIG. 4, wherein the button has been depressed by an off-center actuation force.

Operation of the switch assembly 22 of the invention is further understood with reference to FIGS. 4 and 5. Referring to FIG. 4, actuation of the button member 24 causes the spring plate 40 to close a circuit between the traces 88 and 90. As previously discussed, spring plate 40 includes cantilever springs 77 that extend outward from the plane of the spring plate 40. In a static position (FIG. 4) cantilever springs 77 engage trace 90. When the button member 24 is depressed (FIG. 5), secondary springs 75 of the spring plate 40 are urged into contact with trace 88 to close a circuit between the traces 88 and 90. With the circuit closed, the controller 20, which is connected to the switch assembly 22 at the connector 60, detects a ground signal input from the switch assembly 22.

In a preferred mode of operation, a user applies a force to the actuation portion 34 of the button member 24. Under load, the depression wall 70 of the button member 24 deforms, though the actuation portion 34 substantially retains its shape. The deformation of the depression wall 70 allows the secondary springs 75 to come into contact with the trace 88, closing a circuit and generating a ground signal input to the controller 20. In response, the controller 20 initiates release of the mechanical door latch 16. Because the springs 77 of the leadframe 40 can be compressed even after a circuit between traces 88 and 90 is initially closed, it is possible (while unnecessary) for the user to continue to depress the button member 24 until the components of the switch assembly 22 physically prevent any further travel of the button member 24. Such a feature has been determined to provide a desirable tactile feedback to the user of the switch assembly 22.

With specific reference to FIG. 5, even though the user applies a force that is offset from the center of the actuation portion 34 of the button member 24, the spring plate 40 is able to close a circuit between the traces 88 and 90. When a user applies pressure to the actuation portion 34 of the button member 24 that is off-center, the button member 24 tends to "teeter" or "rock." As shown, however, because of the several cantilever and secondary springs 77, 75 of the spring plate 40, the serpentine nature of the traces 88 and 90, and the fact that the depression wall 70 of the button member 24 deforms before the actuation portion 34, the rocking of the actuation portion 34 of the button member 24 does not adversely affect the switch assembly's 22 ability to close the circuit and produce a ground signal input to the controller 20.

Accordingly, the release of the door latch 16 can be triggered even if the actuation force is applied to the button member 24 off-center of the actuation portion 34.

Figure 6:
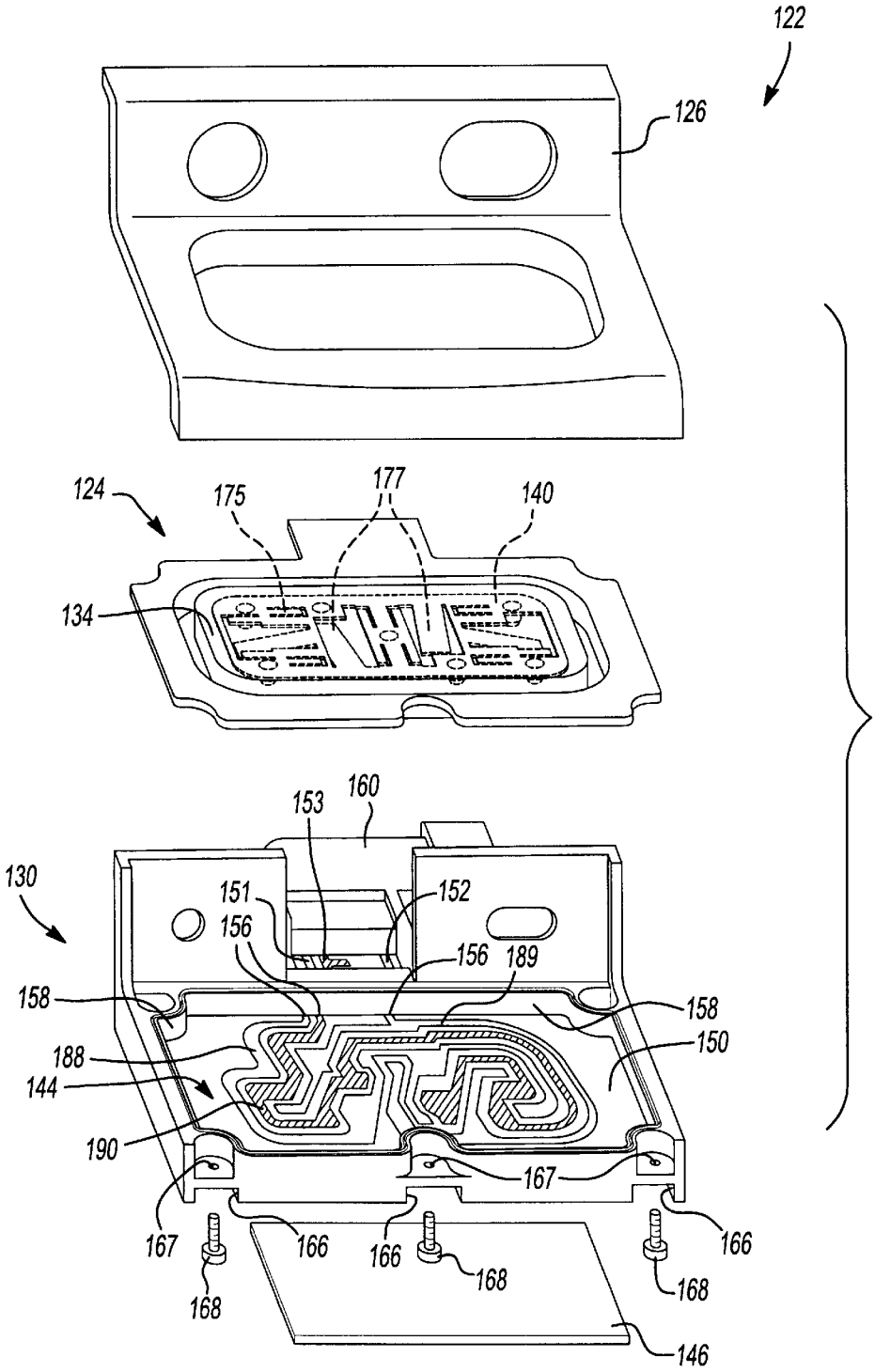
FIG. 6 is an exploded perspective view of a switch assembly in accordance with a second preferred embodiment of the present invention.

Turning now to FIG. 6, a switch assembly 122 according to a second embodiment of the present invention is shown. The switch assembly 122 is described wherein like reference numbers (increased by 100) have been used to designate like components. The switch assembly 122 generally includes a cover member 126, a button member 124, a base member 130 and a spring plate 140. The switch assembly 122 also incorporates a leadframe 144 having a dual-circuit configuration.

The leadframe 144 comprises three electrically conducting traces or tracks 188, 189 and 190. The traces 188 and 189 provide for two inputs and trace 190 provides a ground. The traces 188, 189 and 190 terminate at leads 151, 152 and 153, respectively. As illustrated in FIG. 6, the traces 188, 189 and 190 wind in a generally serpentine manner over the interior surface 150 of the base member 130. The leads 151, 152, and 153 of the leadframe 144 pass through passages 156 that are incorporated in an outer wall 158 of the base member 130. The leads 151, 152, and 153 terminate in the connector 160, which can be coupled to the controller 20.

As a dual-circuit switch, switch assembly 122 can provide two separate ground signal outputs to the controller 20. In such a configuration, both ground signal outputs may be required by the controller 20 to initiate an unlatch of the door latch 16. Alternatively, the programming for the controller may allow the separate outputs to initiate different actions in the controller. The interface of spring plate 140 with leadframe 144 is similar to that of spring plate 40 with leadframe 44. More specifically, cantilever springs 177 engage ground 190 in a static position. Depression of button 134 allows secondary springs 175 to contact lead 188 and/or 189 thereby completing the circuit.

Figure 7:
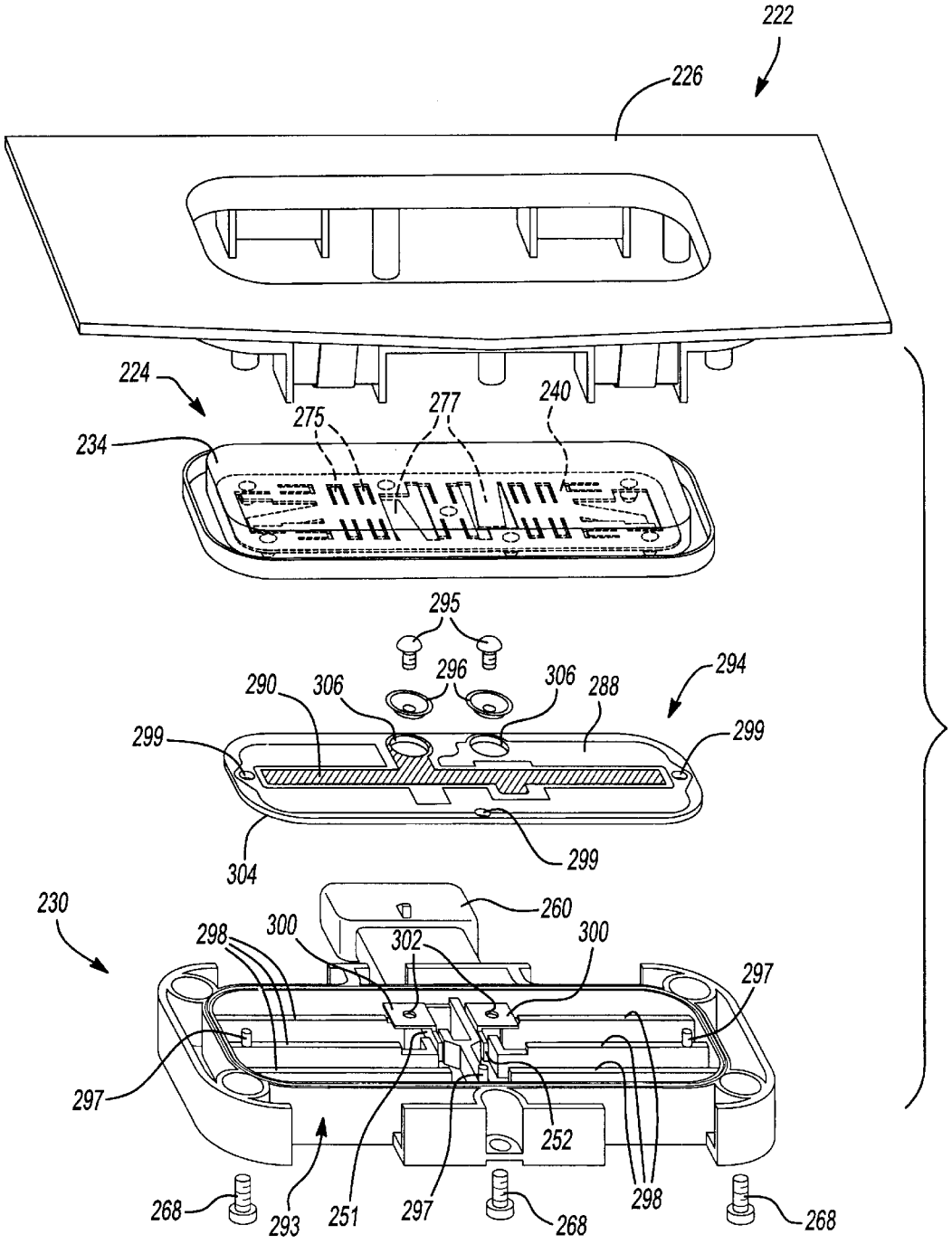
FIG. 7 is an exploded perspective view of a switch assembly in accordance with a third preferred embodiment of the present invention.

Referring to FIG. 7, a switch assembly 222 according to a third embodiment of the present invention is shown. Again, the switch assembly is described wherein like reference numbers (increased by 200) have been used to designate like components. The switch assembly 222 includes a cover member 226, a button member 224, a spring plate 240 and a base member 230. As shown, the switch assembly 222 also incorporates a printed circuit board 294 (PCB) that is separate from the base member 230 in place of a leadframe which is integrally formed in an interior surface of a base member.

The base member 230 comprises a frame portion 293 and a connector portion 260. The frame portion has a plurality of ribs 298 projecting upward from an interior surface of the base member 230. The ribs 298 serve to support the PCB 294 when it is affixed to the base member 230. A plurality of locating pins 297, in turn, project upward from the ribs 298. The pins 297 are cooperable with apertures 299 included in the PCB 294 and serve to properly orient the PCB 294 relative to the body member 230 during the assembly of PCB 294 to the base member 230.

Leads 251 and 252 made from an electrically conductive material, such as a copper alloy, for example, are integrally disposed within the base member 230, such as by insert molding. The leads 251 and 252 incorporate pads or bosses 300 each having an aperture 302 suitable for receiving a fastener 295.

The PCB 294 comprises a substrate 304 upon which are incorporated electrically conductive traces 288, 290. The traces 288, 290 on the PCB 294 create a single-circuit switch representing an input and a ground respectively. The PCB 294 has two apertures 306, one each at an end of the traces 288, 290. Received within each of the apertures 306 is a washer 296. The washers 296 are also made from an electrically conductive material and when they are installed they are in contact with the traces 288, 290. A copper alloy is preferred. The PCB 294 is fastened to the base member 230 by metal fasteners 295 which pass through the apertures 302 in the PCB 294 and are received in the apertures 302 of the pads 300. As such, an electrically conductive path is completed from the leads 251, 252 to the traces 288, 290.

Operation of switch assembly 222 will now be described. In a static position, cantilever springs 277 engage ground 290. Depression of button 234 allows secondary springs 275 to contact input 280 thereby completing the circuit.

The above-described control schemes have the important advantage that the switch assembly may be actuated without having to press a button directly at its center. Thus, a larger, more ergonomic and aesthetically pleasing button member may be used in the switch assembly.

Additionally, and among other advantages, the present invention can be implemented using low-cost manufacturing methods and materials because the reliability of the switch assembly is enhanced with the disclosed design. For example, the cover member, button member and base member may be molded from plastics. Also, the spring plate may employ metal plating, such as silver plating, to provide for or enhance its conductivity.

Those skilled in the art can appreciate from the foregoing description that the broad teachings of the present invention may be implemented in a variety of forms. For example, while single circuit switches have been described in relation to the first and third embodiments of the invention and a dual circuit switch has been described as part of the second embodiment, each embodiment may be modified to accommodate switches having one, two or more circuits. Therefore, while this invention has been described in connection with particular examples thereof, the true scope of the invention should not be so limited since other modifications will become apparent to the skilled practitioner upon a study of the drawings, specification and following claims.

What is claimed is:

1. A switch assembly for triggering the release of a latch mechanism, said switch assembly comprising:

a cover member;

a base member having an interior surface;

a button member disposed intermediate said cover member and said base member, said button member comprising an exterior surface, an interior surface and a plurality of elastomeric projections extending from said interior surface;

an electrically conductive spring plate disposed adjacent to said interior surface of said button member, said spring plate comprising a plurality of apertures through which said plurality of projections of said button member are received, said projections of said button member engaging said apertures of said spring plate and securing said spring plate against said interior surface of said button member; and a leadframe on said interior surface of said base member, said leadframe comprising a plurality of electrically conductive tracks;

and wherein depressing said button causes at least a portion of said spring plate to close an electrical circuit between at least two of said electrically conductive tracks of said leadframe.

2. The switch assembly of claim 1 wherein said button is unitary.

3. The switch assembly of claim 1 wherein said button includes a raised inboard edge extending around the perimeter of said spring plate.

4. The switch assembly of claim 3 wherein said base member further comprises a ridge extending about the periphery of said leadframe, said ridge aligning with and recessing into said raised inboard edge of said button to form a seal thereat in an assembled condition.

5. The switch assembly of claim 1 wherein said leadframe further comprises a plurality of leads, said base member further comprises a sidewall and a connector portion, and wherein each of said plurality of leads are extending through said sidewall to said connector portion.

6. The switch assembly of claim 5 further comprising a sealant disposed about said plurality of leads of said leadframe.

7. The switch assembly of claim 1 wherein said base member further comprises a noise dampening member disposed on an exterior surface of said base member.

8. The switch assembly of claim 1 wherein said leadframe is insert molded into said interior surface of said base member.

9. The switch assembly of claim 1 wherein said leadframe comprises a printed circuit board.

10. The switch assembly of claim 9 wherein said printed circuit board is attached to said interior surface of said base member by a plurality of fasteners.

11. A switching apparatus for completing a circuit to actuate a closure member, the apparatus comprising:

an elastomeric button including at least one elastomeric post extending from an inboard surface thereof;

an electrically conducting plate including at least one aperture for accepting said at least one elastomeric post therethrough, said at least one post retaining said spring plate adjacent to said inboard surface;

a base supporting said button;

a printed circuit board retained to said base and having a ground and at least one input formed thereon; and wherein actuation of said button causes said spring plate to contact said ground to said at least one input thereby completing the circuit and actuating the closure member.

12. The switching apparatus of claim 11 wherein said button is unitary.

13. The switching apparatus of claim 11 wherein said button includes a raised inboard edge extending around the perimeter of said spring plate.

14. The switching apparatus of claim 13 wherein said base includes a raised ridge extending around the perimeter of said printed circuit board, said raised ridge aligning with and recessing into said raised inboard edge of said button to form a seal thereat in an assembled condition.

15. The switching apparatus of claim 11 wherein said printed circuit board is retained into said base by at least one fastener and at least one washer, said washer arranged between said fastener and said printed circuit board and providing electrical communication between said input and said ground to a respective raised boss extending from said base, said raised boss electrically communicating through passages incorporated on said base to an external connector extending from said base.

16. The switching apparatus of claim 11 wherein the closure member includes one of a hinged door, liftgate, trunk, hood and sliding door.

17. A method of assembling a switching apparatus for a door latch, said method comprising:

providing an elastomeric button having a plurality of elastomeric posts extending from an inboard side thereof;

providing an electrically conducting spring plate having a plurality of complementary apertures thereon for accepting said plurality of elastomeric posts;

placing said spring plate over said inboard side of said button such that said posts of said button extend through said apertures of said spring plate;

stretching said posts in a direction away from said spring plate thereby reducing the diameter of said posts and urging said spring plate toward said inboard side of said button;

releasing said posts thereby allowing said posts to relax to a pre-stretched diameter and thereby further urging said spring plate into contact with said inboard side of said button; and installing said button into a base.

18. The method of claim 17, further comprising cutting and removing a portion of each of said posts extending away from said spring plate.

19. The method of claim 17, further comprising securing a leadframe onto an inboard surface of said base, said leadframe aligned to cooperate with said spring plate upon actuation of said button.

20. The method of claim 19 wherein securing a leadframe includes insert molding said leadframe onto said inboard surface of said base.

21. The method of claim 19 wherein securing a leadframe includes coupling said leadframe onto said inboard surface with fasteners.

22. The method of claim 19, further comprising sealing a passage in said base where leads extend from said leadframe and out of said base.

23. The method of claim 22 wherein sealing a passage includes injecting a flowable sealant onto said passage.

24. The method of claim 17 wherein installing said button includes aligning a raised inboard perimeter of said button with a complimentary raised ridge on said base.

25. The method of claim 24, further comprising placing said button between said base and a cover plate and subsequently drawing said cover plate toward said base with fasteners and forming a seal at said raised perimeter of said button and said raised edge of said base.

* * * * *